US007967411B2

(12) United States Patent
Nitta et al.

(10) Patent No.: US 7,967,411 B2
(45) Date of Patent: Jun. 28, 2011

(54) LIQUID EJECTING APPARATUS, WIPING METHOD OF LIQUID EJECTING HEAD, AND PRINTING APPARATUS

(75) Inventors: Masaki Nitta, Yokohama (JP); Katsushi Hara, Yokohama (JP); Jun Shimoji, Tokyo (JP); Kazuhiko Sato, Tokyo (JP); Hiroaki Kato, Yokohama (JP); Yasuyuki Takanaka, Yokohama (JP); Shuuichi Masuda, Yokohama (JP); Toshiaki Yamaguchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 12/127,695

(22) Filed: May 27, 2008

(65) Prior Publication Data

US 2009/0109258 A1 Apr. 30, 2009

(30) Foreign Application Priority Data

Jun. 1, 2007 (JP) ..... 2007-147475

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

2006/0061617 A1* 3/2006 Udagawa ..... 347/23

* cited by examiner

*Primary Examiner* — Julian D Huffman
*Assistant Examiner* — Jason S Uhlenhake
(74) *Attorney, Agent, or Firm* — Canon USA Inc. IP Division

(57) ABSTRACT

An apparatus includes a liquid ejecting head capable of ejecting liquid from a plurality of ejection ports by driving a plurality of ejection energy generation elements corresponding to the plurality of ejection portions. The apparatus includes a wiping mechanism capable of wiping an ejection port face in which a plurality of ejection ports is arranged in the liquid ejecting head. The ink ejection from the plurality of ejection ports is performed in a manner of a plurality of divisions. A time interval from a last wiping to a next wiping is adjusted according to an interval of the ejection energy generating elements corresponding to an adjacent ejection port.

6 Claims, 9 Drawing Sheets

| EJECTION PORT NUMBER | | | |
|---|---|---|---|
| PRINTING MODE | PRINTING MODE I | PRINTING MODE II | PRINTING MODE III |
| 0 | 1 | 1 | 1 |
| 1 | 11 | 6 | 9 |
| 2 | 2 | 11 | 5 |
| 3 | 12 | 16 | 13 |
| 4 | 3 | 2 | 17 |
| 5 | 13 | 7 | 3 |
| 6 | 4 | 12 | 11 |
| 7 | 14 | 17 | 7 |
| 8 | 5 | 3 | 15 |
| 9 | 15 | 8 | 19 |
| 10 | 6 | 13 | 2 |
| 11 | 16 | 18 | 10 |
| 12 | 7 | 4 | 6 |
| 13 | 17 | 9 | 14 |
| 14 | 8 | 14 | 18 |
| 15 | 18 | 19 | 4 |
| 16 | 9 | 5 | 12 |
| 17 | 19 | 10 | 8 |
| 18 | 10 | 15 | 16 |
| 19 | 20 | 20 | 20 |

FIG.3

| | PRINTING MODE I | PRINTING MODE II | PRINTING MODE III |
|---|---|---|---|
| DOT COUNT WEIGHTING COEFFICIENT | 0.6 | 0.8 | 1.0 |

FIG.9

LIQUID EJECTING APPARATUS, WIPING METHOD OF LIQUID EJECTING HEAD, AND PRINTING APPARATUS

BACKGROUND OF THE INVENTION

1. Field of the Invention

The present invention relates to an apparatus in which printing is performed by ejecting liquid, and wiping is performed with respect to an ejection port face ejecting the liquid, a wiping method of liquid ejecting head, and a printing apparatus.

2. Description of the Related Art

In recent years, an ink jet printing apparatus has become widely popular. The ink jet printing apparatus makes a printing head scan with respect to a printing medium, and performs printing by ejecting ink droplets from the printing head at the time of this scanning. Such an ink jet printing apparatus is easily downsized, and has advantages such that color printing can be performed relatively simply.

When the printing is performed in such a way that the ink is ejected from the ink jet printing apparatus, a small amount of ink having failed to become the ink droplet among ink ejected from the ejection port may float between the ejection port and the printing medium in a misty state. Furthermore, the ink may be splashed when impacted against the printing medium, and the ink splashed may float between the ejection port and the printing medium in a misty state. Hereinafter, the mist of ink floating between the ejection port and the printing medium is called "ink mist". There is a concern that the ink might block a part of the ejection port or all of the ejection port in such a manner that such an ink mist adheres around the ejection port. And there is a concern that the ink cannot be ejected when the ink has blocked the ejection port. Furthermore, there is a concern that a failure that an impacting accuracy of the ink decreases or the like might occur when an ejecting direction of the ink is changed by the ink having covered the ejection port, and that the ink cannot impact a predefined location even when the ink can be ejected. Additionally, when the ink mist is generated and adheres around the ejection port, a state in which a vicinity of the ejection port becomes damp by the adhered ink mist is produced. Accordingly, there is a possibility that foreign matter such as paper powder, dust or the like floating between the ejection port and the printing medium might easily adhere around the ejection port due to the wet condition of the ejection port. When such foreign matter adheres around the ejection port, there is a concern that ejecting miss or ejection failure might occur in the same way that the ink mist covers the ejection port in such a state that the adhered foreign matter covers the ejection port.

Accordingly, for keeping a periphery of the ejection port in good condition, a recovery operation periodically removing the ink or the foreign matter which adheres around the ejection port is performed. As a recovery member performing the recovery operation in the ink jet printing apparatus, for example, a wiping mechanism having a blade or the like at a main scanning direction end of the printing head in the ink jet printing apparatus may be sometimes arranged. And then, when a state in which the wiping is required occurs, the printing head is transferred to a location at which the wiping mechanism is arranged, and the wiping is performed in such a way that the printing head is wiped by the wiping mechanism. In such an ink jet printing apparatus, when the printing head and the blade move relatively, the blade wipes an area around the ejection port, and at this time, the foreign matter or the ink which adheres around the ejection port is rubbed and stuck to the blade side. Accordingly, the foreign matter or the like is wiped and removed from a periphery of the ejection port.

Furthermore, with respect to ink increased viscosity or other foreign matter which is hard to completely remove even by such a wiping manner, it is solved by periodically performing a suction operation to absorb the ink from the ejection port by a negative pressure generated by a pump after capping the ejection port face. Additionally, for the recovery operation in addition to this, after capping the ejection port face, a preliminary ejecting operation which ejecting the determined amount of ink may be sometimes performed separately with respect to a process of ejecting the ink for printing.

With regard to the wiping mentioned above, a control executing the wiping when an adhering condition of the ink near the ejection port reaches a determined state is sometimes employed. By employing such a method, the wiping can be performed efficiently without decreasing throughput, and the ejection can be kept in excellent condition. With regard to such method, for example, in Japanese Patent Laid-Open No. 1995-125228, a method of determining a timing executing the wiping has been proposed by employing timing measurement by a timer and a counting of ink ejecting frequency from the printing head (dot count). Furthermore, in Japanese Patent Laid-Open No. 2001-121717, a method of determining a timing executing the wiping in combination with a normal dot count and measurement of printing duty is disclosed. Additionally, in Japanese Patent Laid-Open No. 2006-240177, a method of determining a timing executing the wiping in combination with the normal dot count and a measurement of generation condition of the ink mist according to the type of ink is disclosed.

However, some ink jet printing apparatuses perform an ejection of the ink by a so-called time sharing drive by which the timing ejecting the ink is shifted for each ejection port with respect to the printing head having a plurality of ejection ports. Accordingly, a maximum consumption power used for one time ejection can be kept low in such a way that a drive timing of ejection energy generating element corresponding to the ejection port is scattered by shifting the ejection timing of the ink.

However, there is a possibility that a problem might occur by shifting the timing of the ejection of the ink accordingly. There is a concern that among two ejection ports adjacent to each other, when the ink is ejected from the one ejection port before the other ejection port ejects the ink, a vibration of the ink within the one ejection port might be transmitted to the other ejection port. In this case, there is a concern that a meniscus of the ink within the other ejection port becomes unstable, which may cause ink ejecting from the ejection port to become unstable, consequently, the ink mist might be generated at the time of its ink ejection.

With respect to such a problem, an interval at which mutually adjacent ejection ports eject the ink is sometimes shortened so that the adjacent ejection ports may not interfere with each other. Accordingly, the ink can be ejected from the one ejection port before a pressure fluctuation of the other ink of the mutually adjacent ejection ports is transmitted by shortening the interval of the ink ejection. Accordingly, generation of the ink mist can be suppressed at the time of the ink ejection.

Furthermore, depending on the type of printing image or the like, there is sometimes a case that a solution in which the ejecting interval of the ink ejected from the mutually adjacent ejection ports is changed variously is thought to be preferable. For example, when an image such as a longitudinal ruled line is formed, it is preferable to make the ink ejecting interval from the mutually adjacent ejection ports relatively long.

However, when an interval of drive timing between the ejection energy generating elements arranged at a location corresponding to the adjacent ejection port can be adjusted accordingly, the amount of generation of the ink mist by the ejection of the ink becomes unstable. Accordingly, the amount of generation of the ink mist becomes variable depending on an operation in which the interval of the drive timing between the ejection energy generating elements arranged at the location corresponding to the adjacent ejection port is adjusted and varied. With respect to the amount of generation of the ink mist correspondingly variable, an operation in which the wiping is performed at a fixed timing as with a conventional manner cannot efficiently remove the ink adhered around the ejection port. When the amount of generation of the ink mist increases in such a way that the interval of the drive timing between the ejection energy generating elements arranged at the location corresponding to the adjacent ejection port is set long, and wiping frequency is set too low in connection with this, there is a concern that ejection failure might occur. Specifically, there is a possibility that the ejection of the ink could not be performed because the ink adhered around the ejection port covers the ejection port, or the impact accuracy of the ink might become low. Furthermore, the amount of generation of the ink mist decreases in such a manner that the interval of the drive timing between the adjacent ejection energy generating elements is set short, and regardless of this, unnecessary wiping is performed, consequently, wiping frequency is thought to be too high. In this case, there is a concern that the throughput of the printing might become low because the printing takes much time by unnecessary wiping operation.

SUMMARY OF THE INVENTION

An embodiment of the present invention provides a liquid ejecting apparatus which can efficiently suppress a phenomenon in which liquid adheres around an ejection port in such a way that wiping is also performed at a suitable timing with respect to a liquid ejecting head unstable in the amount of generation of mist caused by ejecting liquid. A liquid ejecting apparatus, which ejects a liquid using the liquid ejecting head capable of ejecting a liquid from a plurality of ejection ports by driving a plurality of ejection energy generating elements corresponding to the plurality of ejection ports, comprises: a wiping mechanism capable of wiping a ejection port face in which a ejection port is arranged in a liquid ejecting head; and a wiping interval adjusting mechanism controlling the wiping mechanism so that an interval from the last wiping to the next wiping can be adjusted depending on a drive order (an interval of drive) of the plurality of (corresponding to an adjacent ejection port) ejection energy generating elements.

According to an embodiment of the present invention, an ejection port face in the liquid ejecting head can be wiped in suitable timing according to an amount of generation of the ink mist generated by ejecting liquid. Accordingly, the wiping can be efficiently performed while suppressing an adhesion of the liquid around the ejection port. Accordingly, this can prevent a phenomenon in which the liquid ejection cannot be performed because the liquid adhered around the ejection port covers the ejection port, or impact accuracy decreases. Furthermore, at this time, since unnecessary wiping can be suppressed, the ejection of the liquid can be performed without decreasing throughput by means of the liquid ejecting head.

Further features of the present invention will become apparent from the following description of exemplary embodiments (with reference to the attached drawings).

BRIEF DESCRIPTION OF THE DRAWINGS

FIG. 3 is an explanatory view showing an order of ink ejection by printing modes I, II and III in the embodiment relating to the present invention;

FIG. 9 is a table of coefficients multiplied with respect to a count value of an actual printing dot number in each printing mode to calculate the weighting count value D.

DESCRIPTION OF THE EMBODIMENTS

Figure 1:
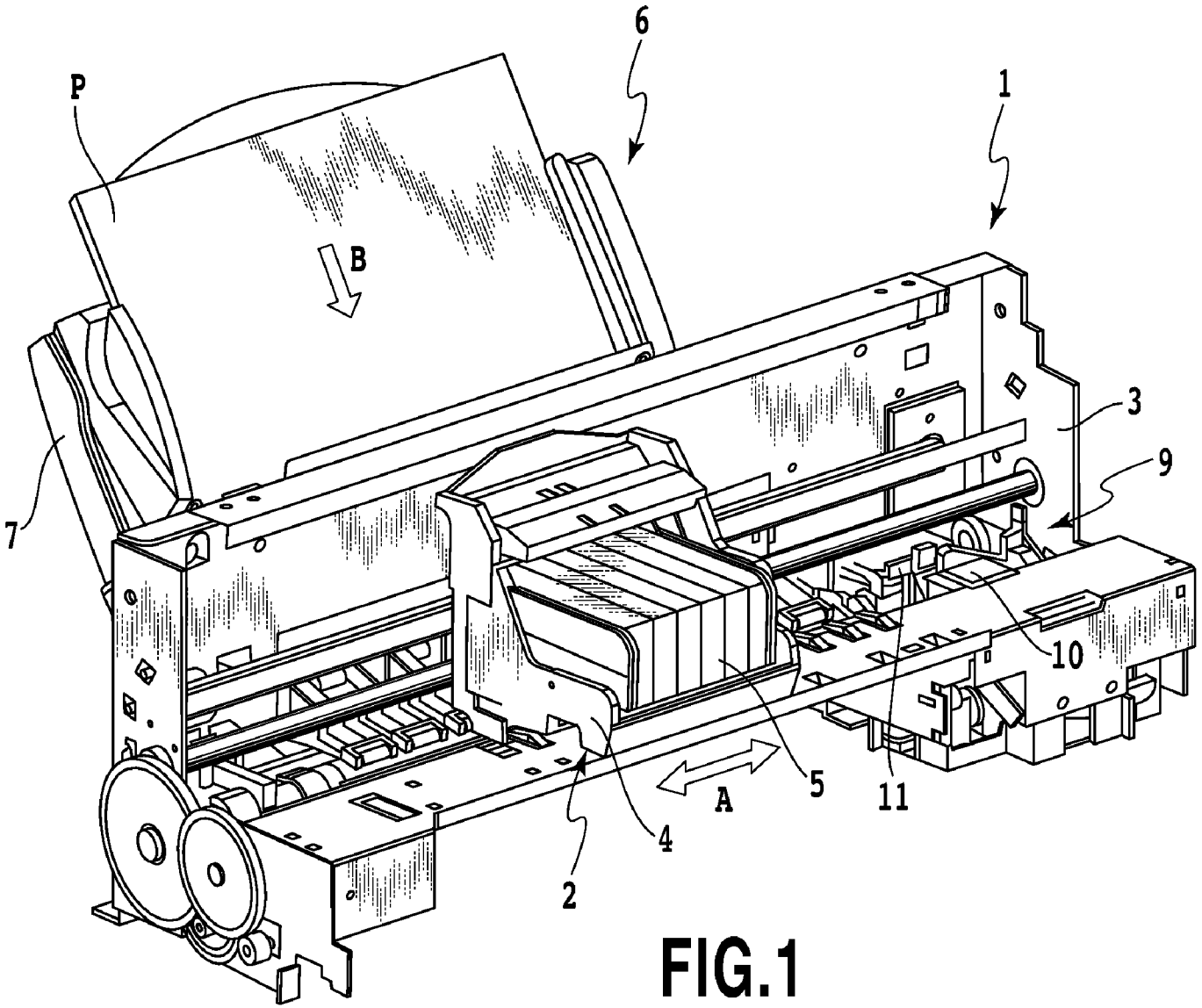
FIG. 1 is a perspective view of a printing apparatus in an embodiment relating to the present invention.

Hereinafter, embodiments for executing the present invention are explained by referring to the drawings.

FIG. 1 is a perspective view of a printing apparatus 1 functioning as a liquid ejecting apparatus used for an ink jet printing apparatus which has a printing head functioning as a liquid ejecting head of the present invention. A printing head 2 used in the present embodiment functions as the ink jet printing head used for the printing apparatus 1 ejecting ink to a printing medium P.

The printing apparatus 1 has a chassis 3 and a carriage 4 capable of scanning in a main scanning direction shown as an arrow A with respect to the chassis 3. Inside the carriage 4 movably supported with respect to the chassis 3, a plurality of ink jet cartridges 5 is supported to be removable. In an embodiment, six ink jet cartridges 5 are housed. Each of the ink jet cartridges 5 corresponds to each of the colors of black (K), cyan (C), light cyan (LC), magenta (M), light magenta (LM), and yellow (Y) for corresponding to each color printing. And, in each of ink tanks (not shown) of each of the ink cartridges 5, an ink corresponding to each of the colors is stored. Furthermore, each of the ink jet cartridges 5 has the printing head 2 capable of ejecting the ink to a face facing to the printing medium P.

Additionally, the ink is supplied from the ink tank (not shown) in the ink jet cartridges 5 to the printing head 2. In a face facing to the printing medium P in each of the printing heads 2, a plurality of ejection ports is formed. A face in which the ejection port is formed in the printing head 2 is defined as an ejection port face for explanation. In the present embodiment, 640 points of ejection ports of each color in the ejection port face in the printing head 2 are arranged linearly in a manner of 2 lines. Furthermore, in a relationship between nozzle arrays of an odd number and an even number, they are arranged to be displaced in a nozzle arrangement direction by half of a nozzle interval.

Inside the printing head 2 of the present embodiment, a heater functioning as an electro-thermal conversion element (not shown) for converting electric energy into thermal energy which functions as an ejection energy generating element is arranged. The ink is ejected from each ejection port in such a way that film boiling is generated in the ink around the heater by the thermal energy generated by the heater, and that kinetic energy is applied to the ink by utilizing foaming pressure generated by a growth and a contraction of a bubble by the film boiling. The heater is arranged at each location corresponding to each ejection port, and to each heater, a drive pulse voltage for generating the film boiling in the ink by heating the heater instantly for ejecting the ink is applied.

In a back portion of the chassis 3, a paper feeding mechanism 6 is arranged, and the paper feeding mechanism 6 has a paper feeding tray 7. On the paper feeding tray 7, a plurality of printing medium P is stacked and is set. After the printing medium P set in the paper feeding tray 7 is taken out sheet by sheet, it is conveyed to a printing position while being sandwiched by a plurality of pair of rollers (not shown), and after the printing has been finished, it is conveyed to a paper discharge tray (not shown) while being sandwiched by the plurality of pair of rollers (not shown).

In an end side of the carriage 4 in the main scanning direction in the printing apparatus 1, a recovery unit 9 is arranged. The end side in the main scanning direction, at which the recovery unit 9 is arranged, in the printing apparatus 1 is set to be a home position. The recovery unit 9 has a suction cap 10 and a blade 11.

The suction cap 10 is arranged at a location at which capping is possible with covering the ejection port face when the printing head 2 is located at the home position. After the ejection port face of the printing head 2 has been capped by the suction cap 10, negative pressure can be generated inside the suction cap 10 by a suction pump (not shown). "Suction recovery" sucking out the ink and the foreign matter inside each ejection port is performed by generating the negative pressure inside the suction cap 10 accordingly. Furthermore, a blade 11 functioning as a wiping mechanism capable of wiping the ejection port face is arranged at the home position of the printing apparatus so that it may project from a face in which the suction cap 10 is arranged toward a direction of the ejection port face of the printing head 2.

Next, printing to the printing medium by the printing apparatus 1 is explained.

At the time of the printing, the carriage 4 reciprocates in the arrow A direction of the main scanning direction, and according to the reciprocation, ink droplets are ejected from each ejection port toward the printing medium P. When the carriage 4 reaches the other end side after finishing printing at 1 pass ratio by reciprocating above the printing medium P, the pair of rollers (not shown) are rotated at the fixed number of rotation for conveying the printing medium P, and the printing medium P is conveyed to an arrow B direction of a sub scanning direction. And then, printing is performed while the carriage 4 moves toward the arrow A direction being the main scanning direction again. Accordingly, printing is performed over whole printing medium P in such a way that a printing operation performed together with a transfer of the carriage 4 toward the main scanning direction and a conveying operation of the printing medium P are repeated.

In the above description, the ejection of the ink in the present embodiment employs a method of ejecting the ink by a foaming pressure of bubble generated by boiling the ink inside the printing head 2 by energizing the heater arranged inside the printing head 2. At this time, if all heaters arranged in the printing head 2 are energized at one time, electric power consumed by the heaters becomes excessively large. Accordingly, the heater is driven by a so-called time sharing drive by which a timing of driving the heater is shifted by shifting a timing of energizing the heater. Hereinafter, the ejection of the ink performed by the heater driven by shifting the timing is explained by referring to FIG. 2.

Figure 2:
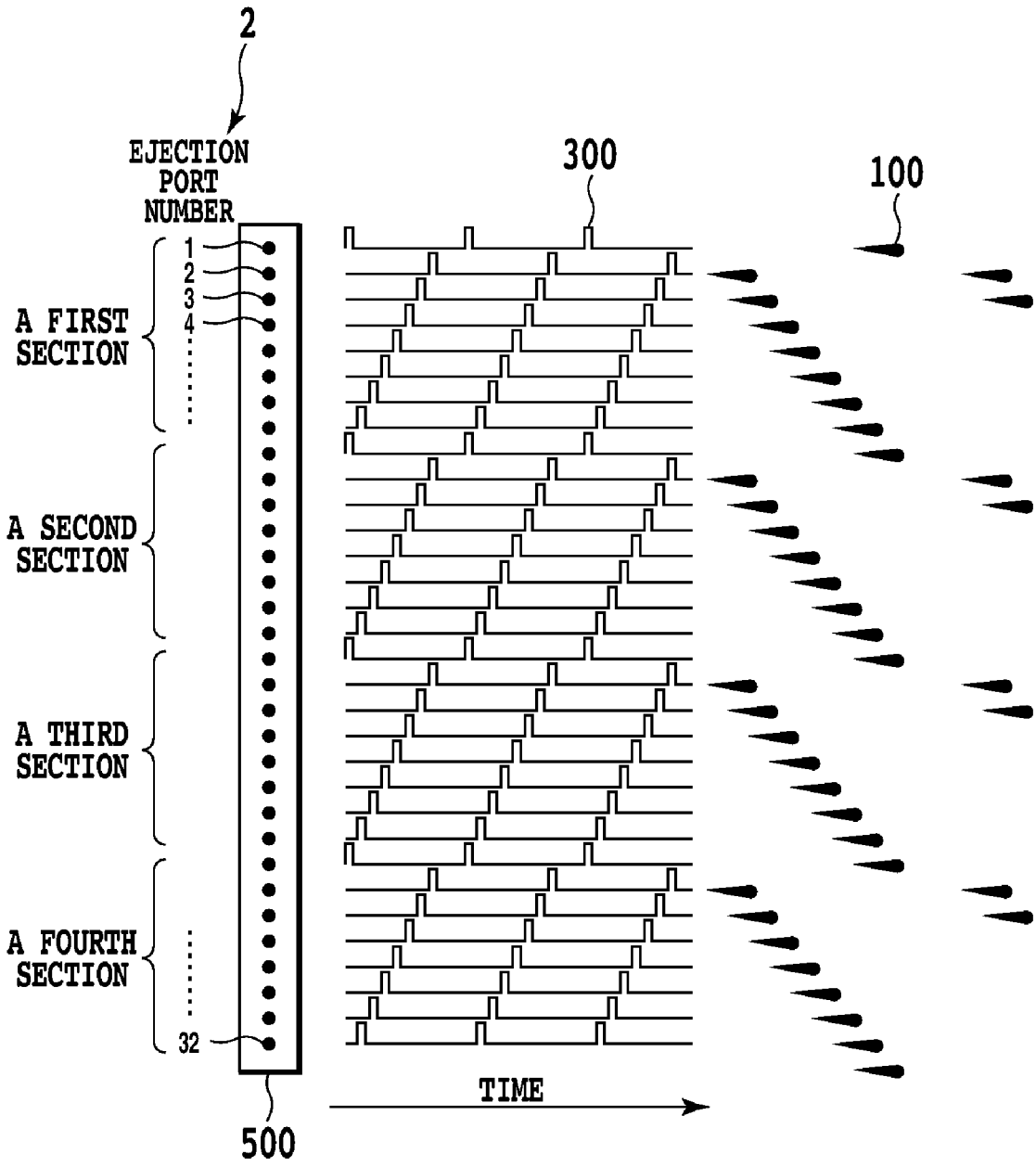
FIG. 2 is an explanatory view for explaining a phenomenon about an ejection of ink which is driven separately.

Although 1280 points of the ejection ports are formed in the ejection ports face in each printing head 2 in the printing apparatus 1 of the present embodiment, here, for simplifying explanation, 32 points of the ejection ports are intended to be formed as with FIG. 2. An ejection ports array 500 in the printing head 2 has 32 points of the ejection ports, and they are divided into 4 sections from a first section to a fourth section as a unit of 8 points each. Furthermore, 8 points of each ejection port inside this each section are further divided into 8 different drive blocks. And, at the time of printing, the heater is driven so that the ejection ports of the same block in each section may eject the ink simultaneously. In the present embodiment, in the printing head 2 shown in FIG. 2 which performs block drive, 4 ejection ports of a first, a ninth, a seventeenth, and a twenty-fifth in the ejection ports array 500 are processed in heater drive as a first drive block. Furthermore, the ejection ports of a second, a tenth, an eighteenth, and a twenty-sixth are driven as an eighth drive block. Accordingly, each heater corresponding to each ejection port is arranged so that it may be driven to be allocated to each drive block periodically. In a procedure shown in FIG. 2, for example, each heater is thought to be driven in order so that it may become an ascending order from the first block to the eighth block. In a time sharing drive by which the heater is driven in order at this block unit, the heaters allocated to the same block of each section are driven simultaneously. In this case, the heater is driven in order by a pulse-like drive signal 300, and according to the drive order, ink droplets 100 are ejected as shown in FIG. 2.

When the ink is ejected from the ejection port, first, as mentioned above, bubble is generated by processing in film boiling the ink around the heater by applying a voltage of constant pulse to the heater. And then, the ink around the heater is pushed out from the ejection port by a volume change of the bubble in a growth process of the bubble. When the ink is ejected from the ejection port, the meniscus of the ink inside the adjacent ejection port vibrates in such a way that not only does the ink inside the ejection port having ejected vibrate, but also the vibration transmits inside the ejection port adjacent to the ejection port. The vibration of the ink inside this adjacent ejection port attenuates as time elapses. However, when the order of the heater driven turns before the vibration has been attenuated completely, the ink is ejected from the ejection port in such a condition that the ink is still vibrating. This unstable ejecting condition becomes smaller in influence as the interval after the adjacent ejection port has ejected the ink becomes shorter. Conversely, since the influence becomes larger as the interval after the adjacent ejection port has ejected the ink becomes longer, the ejection of the ink becomes unstable, therefore, there is a concern that a reduction in impacting accuracy of the ink or a generation of the ink mist might occur. However, when the interval of the ink ejection between adjacent ejection ports is shortened, as described later, when an image longitudinally extending like a ruled line is formed, there is a concern that the image might decrease in quality.

Accordingly, even when the interval of drive timing between heaters arranged at the location corresponding to the adjacent ejection ports is set short or long, failure of ink ejection may occur in each case. This requires that the interval of the drive timing between the heaters arranged at the location corresponding to the adjacent ejection ports should be adjusted according to the printing medium to be printed or the usage of the printing. The printing apparatus 1 of the present embodiment has 3 printing modes different in the interval of the ink ejection from the adjacent ejection ports, therefore, a desired printing mode can be selected among the three printing modes. Among these three printing modes, an appropriate printing mode is selected depending on the type of the printing medium or the usage of the printing.

Hereinafter, the order of separate drive of the heater in the three printing modes in the present embodiment is explained with reference to FIG. 3, FIG. 4, FIG. 5, and FIG. 6. Furthermore, in these FIG. 3, FIG. 4, FIG. 5, and FIG. 6, the order of the drive is explained by picking out 20 points among 1280 points of the ejection ports in the printing head 2 of the present embodiment. With respect to these 20 points of the ejection ports, the number of ejection ports is denoted as 1, 2, 3 . . . to 20. Furthermore, although in the present embodiment, ejection from the 20 points of the ejection ports shown in FIG. 3, FIG. 4, FIG. 5, and FIG. 6 is set to be one group among the block drives having a plurality of blocks, the printing apparatus according to the present invention is not restricted to the block drive. The heater drive is not limited to the block drive, a simple time sharing drive may be employed. Furthermore, the heater drive that all heater drives can be shifted in the timing may be employed.

Figure 4:
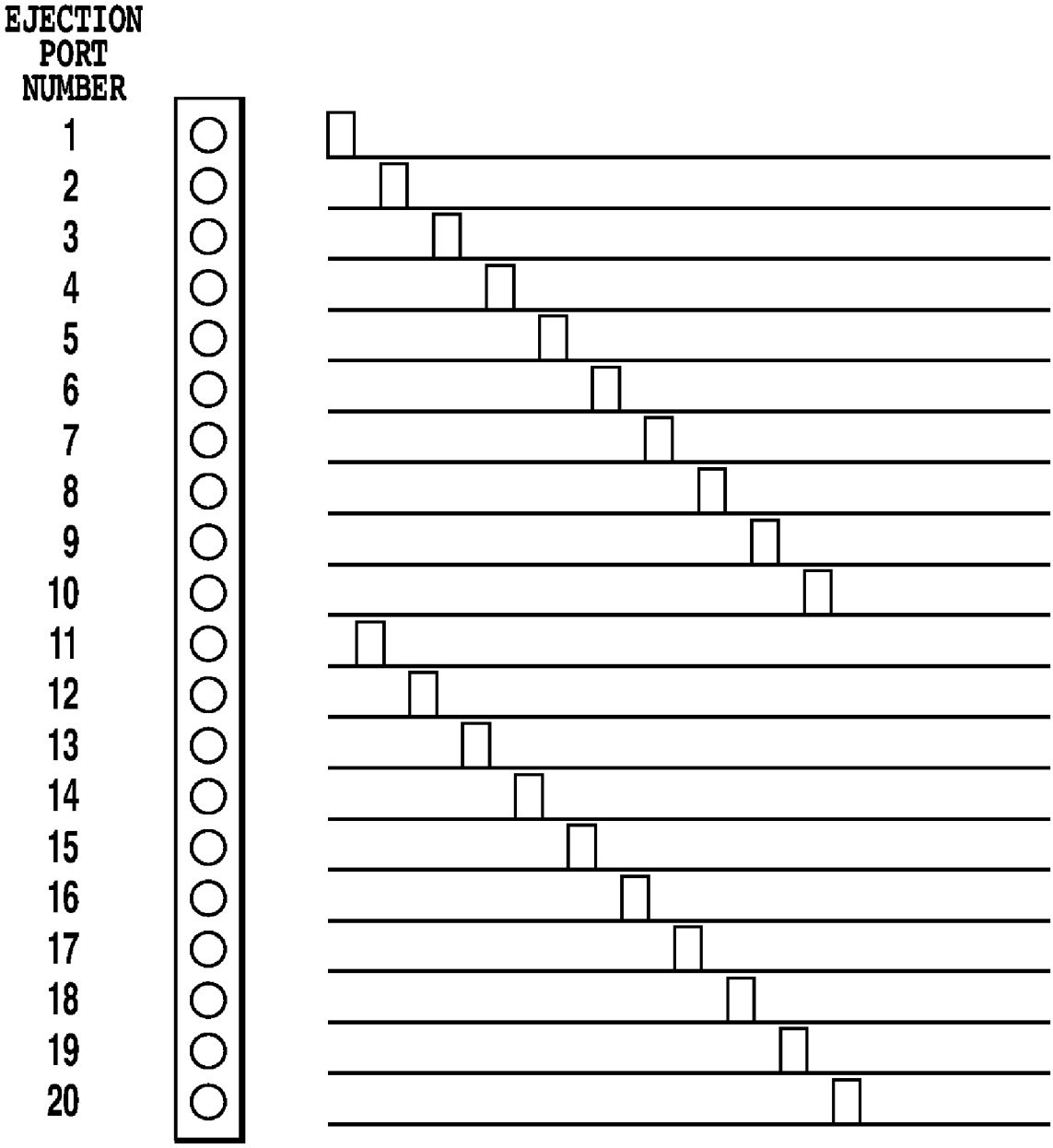
FIG. 4 is an explanatory view for explaining an ink ejection order of the printing mode I of the printing apparatus in the embodiment relating to the present invention.
Figure 5:
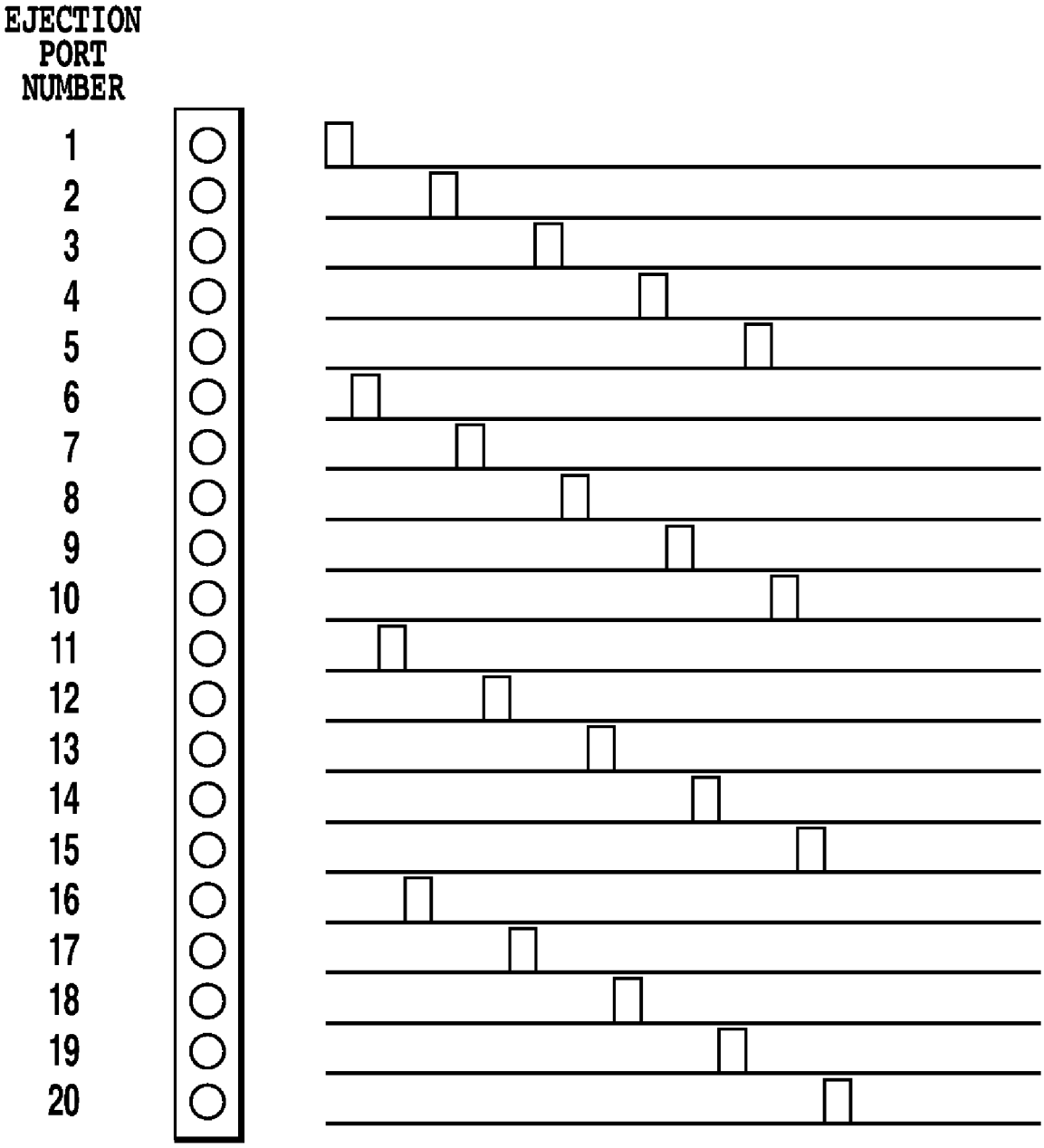
FIG. 5 is an explanatory view for explaining the ink ejection order of the printing mode II of the printing apparatus in the embodiment relating to the present invention.
Figure 6:
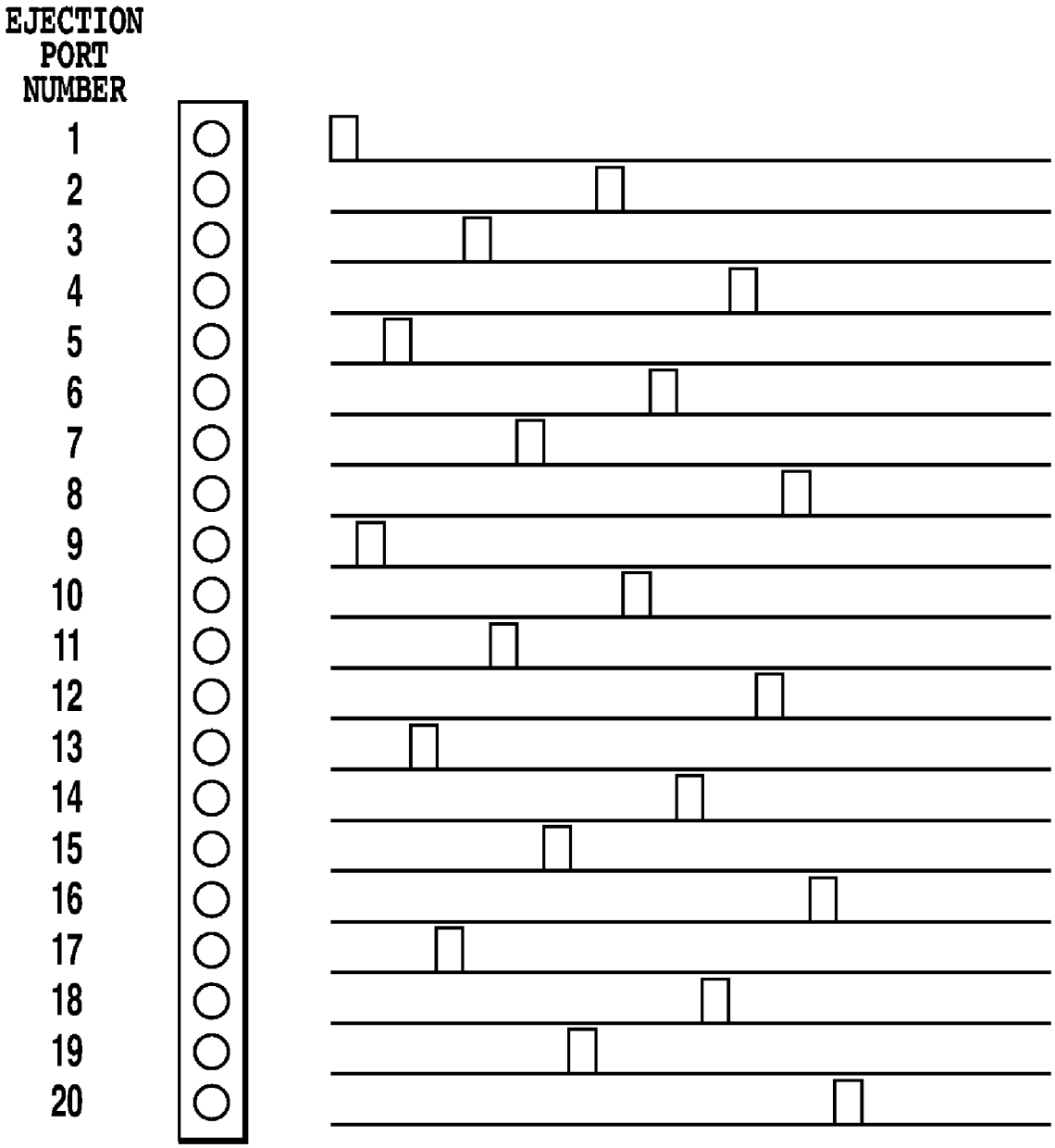
FIG. 6 is an explanatory view for explaining the ink ejection order of the printing mode III of the printing apparatus in the embodiment relating to the present invention.

FIG. 3 shows a drive order of the three printing modes different in the interval of the ink ejection from the adjacent ejection ports. And, FIG. 4, FIG. 5, and FIG. 6 show timings applying pulse currents for heating the heaters in each printing mode. Among these modes, in the mode shown in FIG. 4, the printing mode shortest in the interval of the heater drive between mutually adjacent ejection ports is set to be a printing mode I. Furthermore, as shown in FIG. 5, the printing mode secondarily short in the interval of the heater drive between the mutually adjacent ejection ports is set to be a printing mode II. Additionally, as shown in FIG. 6, the printing mode longest in the interval of the heater drive between the mutually adjacent ejection ports is set to be a printing mode III.

The printing mode I is a printing mode having an order performing ejection in a descending order of the number of ejection ports. And, this mode is set to be shortest in the interval of driving the heater corresponding to the adjacent ejection ports among the three printing modes. Accordingly, when this printing mode I is set, before the vibration of the ink inside the ejection port which is generated by the ink ejection in the adjacent ejection port has transmitted to the ejection port preparing to eject the ink hereinafter, the ink ejection from the ejection port can be finished. Accordingly, this can make the ink ejection finish in a stable condition without making the meniscus of the ink vibrate. As a result, the generation of the ink mist can be suppressed at the time of the ink ejection in such a way that the ink ejection is performed in a stable condition of the meniscus. However, when an image such as a longitudinally ruled line is formed by the printing mode I, there is a concern that its image quality might decrease in such a manner that it is visually recognized as an image linearly discontinuous. That is, there is a concern that the ruled lines might be printed as a plurality of slant lines without being linearly continuous so that it may be along a pattern of the ink ejection timing shown in FIG. 4.

Next, the timing applying the pulse current when the heater is driven by the printing mode II is shown in FIG. 5. The printing mode II has a middle interval between the printing mode I and the printing mode III mentioned later as the interval of the drive timing between the heaters arranged at the location corresponding to the adjacent ejection ports. Accordingly, the amount of generation of the ink mist generated at the time of the ink ejection and the image quality are situated in such a manner between the printing mode I and the printing mode III.

Next, the timing applying the pulse current when the heater is driven by the printing mode III is shown in FIG. 6. The printing mode III is separately set in the interval of the drive timing between the heaters arranged at the location corresponding to the adjacent ejection ports, therefore, it is a printing mode driving the timing of the ejection port performing the ink ejection dispersively as much as possible. In the ink ejection by this printing mode III, the interval of the drive timing between the heaters arranged at the location corresponding to the adjacent ejection ports is set long. Therefore, the vibration of the ink inside the ejection port caused by the ink ejection from the adjacent ejection port transmits to the ejection port prepared to perform the ink ejection hereinafter. Accordingly, since the meniscus of the ink inside the ejection port prepared to perform the ink ejection hereinafter is made to vibrate, the ink ejection is performed in such a condition that it is unstable in the meniscus. Therefore, printing mode III is a printing mode with a large amount of generation of the ink mist at the time of the ink ejection. Conversely, when the ink ejection is performed by the printing mode III, the ink droplets are dispersed properly inside a region of the ruled line prepared to be formed by the ink droplets ejected. Accordingly, a decrease in image quality caused by being printed as a plurality of slant lines is suppressed without the lines being linearly continuous.

Accordingly, since in the printing apparatus 1 in the present embodiment, a plurality of printing modes is set, and the amount of the ink mist generated and a quality of image are different according to the printing mode, at the time of printing, the printing mode can be selected according to the printing medium and the usage of the printing. And, the interval of the drive timing between the heaters arranged at the location corresponding to the adjacent ejection ports can be adjusted. Accordingly, in the printing apparatus 1 of the present embodiment, the order at which the heater is driven is determined according to the amount of generation of the ink mist and the condition of image quality degradation at every printing mode.

Since there is a concern that a condition in which the ink mist generated or the ink adhered to periphery of the ejection port is left as it is in this way might cause ejection failure, for keeping a condition of the ejection port excellent, in the present embodiment, a suction recovery and a wiping are performed as a recovery operation.

In the suction recovery as the recovery operation of the present embodiment, first, after printing has been finished or interrupted, the carriage 4 moves from the printing region to the home position being a location at which the ejection port face and the suction cap 10 in the printing head 2 are contacted with each other. And then, the ejection port face in the printing head 2 is covered by the suction cap 10. Hereinafter, this movement is called "capping". When the suction cap 10 caps the printing head 2, "the suction recovery" sucking out of the ink and the foreign matter inside each ejection port is performed in such a way that a suction pump (not shown) operates, and that a negative pressure is generated inside the suction cap 10. However, since an ink not processed in viscosity increasing is sucked together with the foreign matter adhered near the ejection port or a ink increased viscosity in the suction recovery, some amount of the ink becomes discarded ink in such a manner that it is discarded wastefully without being used for the printing. Accordingly, since the amount of the discarded ink becomes larger as the frequency of the suction recovery becomes greater, it is preferable that the frequency of the suction recovery should be set to be as small as possible.

Furthermore, the wiping as the recovery operation in the present embodiment is performed at a timing at which its process is halfway, finished, or started in the printing. When the wiping is performed during halfway of the printing, it is performed according to the ejecting condition of the ink by the printing apparatus 1. When printing for a designated time or a designated amount has been performed, the carriage 4 moves from the printing region to the home position being the location at which the ejection port face in the printing head 2 and the blade 11 contact each other. The blade 11 projects toward the printing head side while the carriage 4 is moving from the printing region to the home position, and when the carriage 4 locates at the home position, the blade 11 is made to locate so that the blade 11 may contact with the ejection port face. And then, the blade 11 functions as a wiping mechanism in such a way that the blade 11 relatively moves with respect to the carriage 4 in a condition in which the blade 11 and the ejection port face contact each other, and that the ejection port is wiped in such a manner that the blade 11 rubs against the ejection port face. This makes the ink or the dust adhered to the ejection port face move to the blade 11 side. Accordingly, a periphery around the ejection port is recovered in such a way that the ink or the dust adhered around the ejection port periphery in the ejection port face of the printing head 2 is wiped off. A relationship between the wiping in the recovery operation and the suction recovery, here, is explained that the foreign matter adhered to be removed by the wiping is positively removed by the wiping, and that with respect to the ink increasing viscosity or adhered ink which is hard to remove by the wiping, ink is made to be removed by the suction recovery. Furthermore, the wiping is sometimes performed after the suction recovery for removing the ink of the ejection port face which is left even after performing the suction recovery.

For securely removing the ink or the dust of the ejection port by such a wiping, the wiping is required to be controlled at high accuracy by a wiping interval adjusting mechanism. Therefore, a condition where wiping is performed is required to be accurately understood. As the condition where wiping is performed, for example, a head rubbing portion shape and a head rubbing portion water-repellency of the wiping mechanism are included. Furthermore, as other examples, a contact area of the wiping mechanism contacting with the ejection port face, a contact pressure, a contact angle and a relative moving speed between the blade 11 and the carriage 4 and the like are also included. Excellent recovery in the ejection port face is kept by wiping in such a way that a wiping process is controlled excellently in accuracy by exactly understanding these conditions at the time of wiping.

Regarding this wiping condition, it is desirable that a timing of performing wiping should be changed according to the amount of generation of the ink mist when it changes. As mentioned above, the printing apparatus 1 in the present embodiment has three printing modes different in the interval of the ink ejection from the adjacent ejection port, and a desired printing mode is selected from these printing modes. Accordingly, the interval of the ink ejection from the adjacent ejection port becomes different according to the printing mode selected. Furthermore, when the interval of the ink ejection from the adjacent ejection port is different, the amount of generation of the ink mist becomes different at the time of the ink ejection. Accordingly, the timing of performing wiping is determined according to the interval of the ink ejection from the adjacent ejection port. In the present embodiment, according to an ejection order of the ink from the ejection port different based on the printing mode, the interval from the last wiping to the next wiping is adjusted. When the timing of performing wiping is determined based on the number of printing dots, the timing is determined by considering so-called time sharing drive order being the order by which the heater is driven at the time of the ink ejection. In the present embodiment, the timing is determined by considering the time sharing drive order in one block in the block drive.

Figure 7:
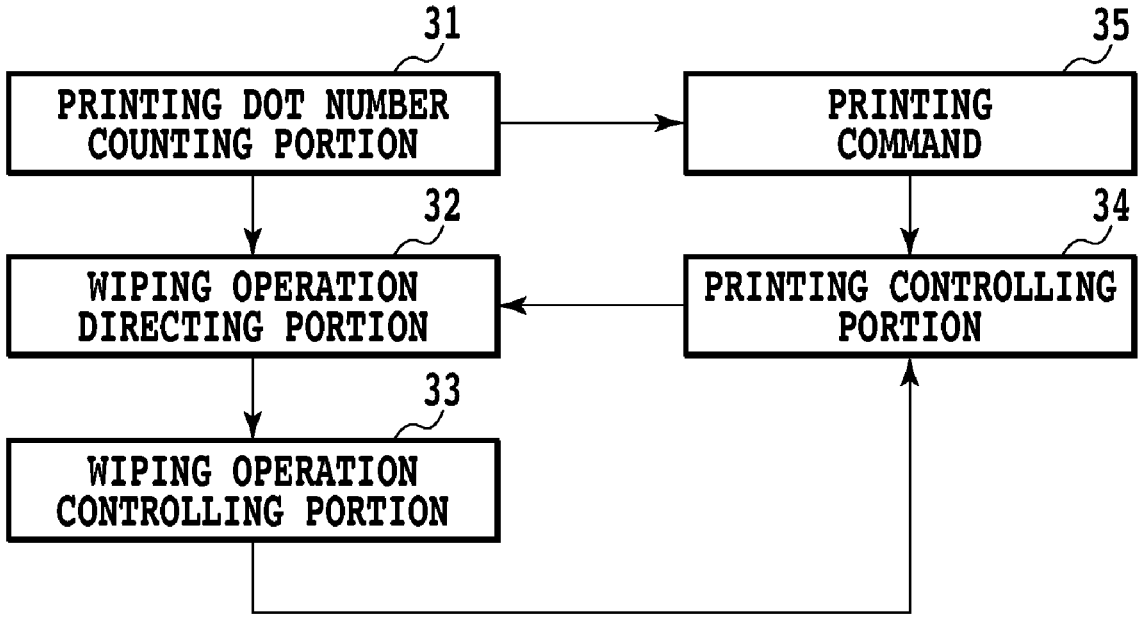
FIG. 7 is a block diagram showing a relationship between portions of a wiping interval adjusting mechanism controlling the wiping mechanism performing the wiping.

Hereinafter, a process in which the timing performing wiping is determined in the present embodiment is explained by referring to the drawings. FIG. 7 is a block diagram showing relationships between each portion of wiping interval adjusting mechanism such as a CPU and a recovery system control circuit which control the wiping mechanism.

When a printing command 35 is inputted, this printing command 35 is sent to a printing controlling portion 34 and a counting portion 31 counting the number of printing dots. The printing controlling portion 34 performs printing by driving each drive portion according to the printing command 35. After that, the counting portion 31, being a count mechanism counting the number of dots, counting the number of printing dots starts counting an ejection frequency of the ink droplets ejected for forming the dots on the printing medium. And then, based on a count value in the counting portion 31, a wiping operation directing portion 32 directs a wiping operation controlling portion 33 to start wiping. Furthermore, according to this direction, the wiping operation controlling portion 33 directs the printing control portion 34 to control the printing head 2 and the carriage 4 in order to perform the wiping operation. Accordingly, the printing apparatus 1 in the present embodiment includes the wiping interval adjusting mechanism controlling the wiping mechanism including the blade 11 or the like so that the interval from the last wiping to the next wiping may be adjusted according to drive orders of a plurality of the heaters.

Figure 8:
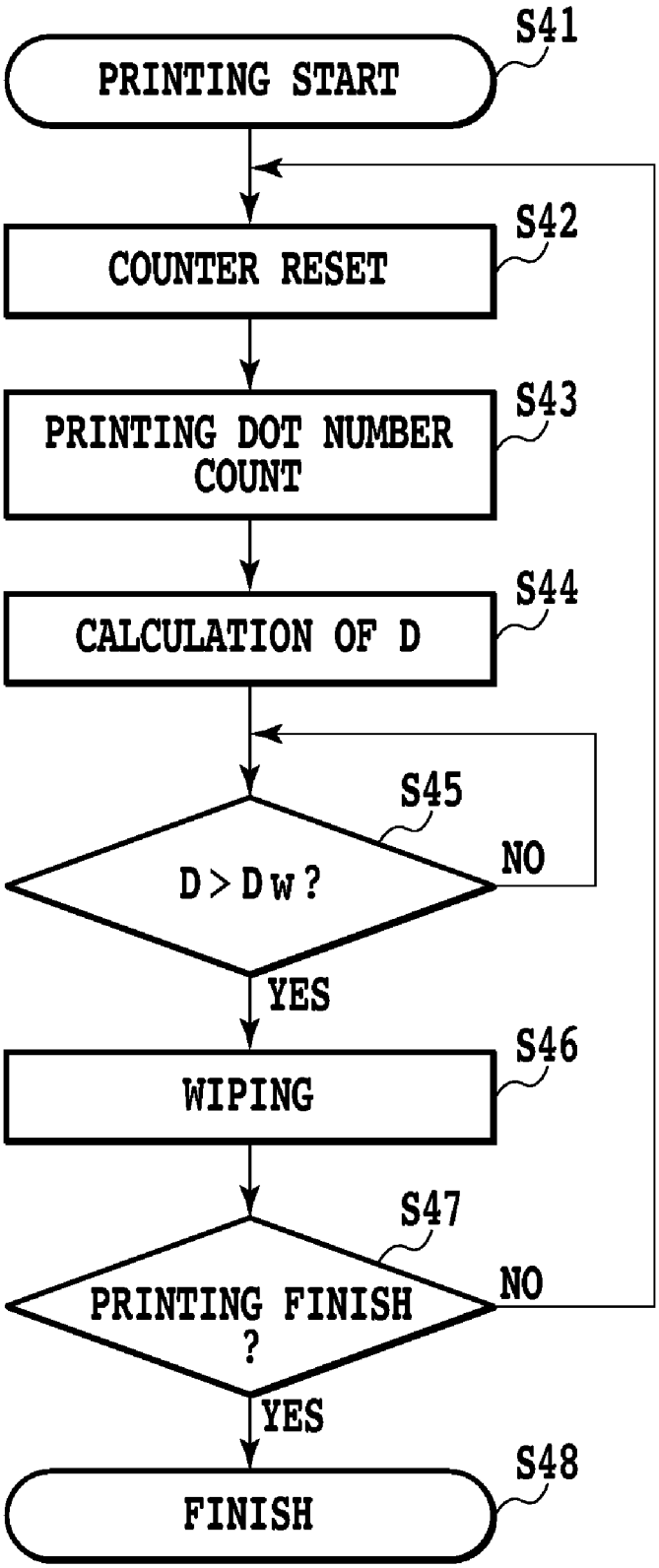
FIG. 8 is a flowchart for explaining a process of performing wiping.

FIG. 8 is a flowchart for explaining a process of performing wiping. When a printing command is inputted (step 41), a value of the counting portion 31 is reset (step 42). And then, the counting portion 31 starts counting (step 43). Additionally, a weighting count value D multiplied by a coefficient with respect to the count value of the counting portion 31 is calculated (step 44). And then, the count value D is compared with a pre-set value Dw of the number of printing dots (step 45), and when the weighting count value D reaches a setting value Dw of the number of printing dots, wiping is performed (step 46). Furthermore, when the wiping process interrupts the operation during a process of ejecting the ink on the printing medium, there is a concern that failure might occur in a process of forming an image. Accordingly, when the weighting count value D exceeds the setting value Dw while ejecting the ink on the printing medium, it is preferable that printing should be continued until printing of 1 scan finishes. At that time, the wiping is executed in a process of a paper feeding timing after 1 scan printing has been performed, or a paper discharge timing after 1 page printing or the like. When wiping has finished, whether printing has finished or not is judged (step 47). When the printing operation continues, the process returns to the step 42, and resets the count value, and the above-mentioned operation is repeated.

Here, a process of the step 43, a process of the step 44, a process of the step 45, a process of the step 46, and a process of the step 47 in the present embodiment is explained. In a process of counting the number of printing dots in the step 43, the weighting process is performed with respect to the number of actual counts based on a value shown in FIG. 9 according to the drive order of the heater determined at every printing mode.

The printing apparatus 1 in the present embodiment has three printing modes of I, II and III. In each of three printing modes of I, II and III, a coefficient according to the interval of the ink ejection from the adjacent ejection port, shown in FIG. 9 is set. This coefficient is determined according to the interval of drive timing between the heaters arranged at the location corresponding to the adjacent ejection ports in the printing modes of I, II and III. And then, with respect to the actual ejection frequency counted by the counting portion 31, a value having been multiplied by the coefficient of FIG. 9 according to the printing mode is set to be the weighting value D. Furthermore, when the cont value D exceeds the setting value Dw, wiping of the ejection port face is performed by the wiping mechanism.

When the printing mode has long interval of the ink ejection from the adjacent ejection port is selected, since the amount of generation of the ink mist is relatively large, the interval at which wiping is performed is relatively shortened. Therefore, as the interval of the ink ejection from the adjacent ejection port becomes longer, the coefficient multiplied by the number of counts is set larger. When the coefficient is set large, since the weighting count value D becomes large, the number of printing dots until it exceeds the setting value Dw becomes less. Accordingly, the number of dots impacted into the printing medium becomes small before wiping is performed, therefore, the interval at which wiping is executed is shortened. That is, when the printing mode which generates large amount of the ink mist is selected, wiping is performed frequently. This can suppress a reduction in ejecting accuracy caused by covering a portion of the ejection port with the adhered ink to occur. Furthermore, a condition of ink ejection failure in which the ink cannot be ejected by covering all portions of the ejection port with the adhered ink can be suppressed to occur.

Furthermore, when the printing mode has short interval of the drive timing between the heaters arranged at the location corresponding to the adjacent ejection port is selected, since the amount of generation of the ink mist caused by the ink ejection is less, the wiping frequency required is relatively less. Conversely, when the wiping frequency increases, since the printing process may be interrupted, the wiping with less frequency is required for improving the throughput of the printing by shortening the time required for the printing. For this reason, the shorter the interval of the ink ejection from the adjacent ejection port becomes, the smaller the setting coefficient multiplied by the number of counts becomes. When the coefficient is set small, since the weighting count value D will not increase even when the same dot number is printed, many printing dot numbers are required until it exceeds the setting value Dw. Accordingly, the dot number impacted into the printing medium until wiping begins increases, therefore, the interval at which wiping is executed becomes long. That is, when the printing mode which generates small amount of the ink mist is selected, the wiping frequency becomes less, and then a time during which the printing process is interrupted by the wiping operation decreases, therefore, a time required by the printing can be kept short.

Accordingly, the longer the interval at which the adjacent ejection port ejects the ink becomes, the smaller the coefficient becomes. Conversely, the shorter the interval at which the adjacent ejection port ejects the ink becomes, the larger the coefficient becomes. In the present embodiment, in a table shown in FIG. 9, the coefficients are set to be 0.6 for the printing mode I, 0.8 for the printing mode II, and 1.0 for the printing mode III. Accordingly, in the printing mode having an interval relationship of I<II<III in magnitude at which the adjacent ejection port ejects the ink, the coefficient is set to be I<II<III in magnitude. In the present embodiment, in the printing mode III which generates relatively large amount of the ink mist, the count number of the counting portion 31 is set to be the count value D as it is. Furthermore, in the printing mode I which generates relatively small amount of generation of the ink mist, a value obtained by multiplying 0.6 to the count number of the counting portion 31 is set to be the weighting count value D. When the printing mode III which generates relatively large amount of the ink mist is applied, this suppresses a failure of the ink ejection to occur because wiping becomes short in the interval. In contrast, a time during which printing is interrupted by the wiping is kept short by decreasing the wiping frequency in the printing mode I which generates relatively small amount of the ink mist, therefore, a time required for the printing is shortened, and the throughput in the printing is improved simultaneously.

Accordingly, in the present embodiment, the wiping interval adjusting mechanism commands the wiping mechanism to perform wiping of the ejection port face when the ejection frequency counted by the dot number counting mechanism exceeds a setting value set in advance. Additionally, in each of the printing modes, a coefficient is set according to the interval of the drive timing between energy generating elements arranged at the location corresponding to the adjacent ejection port. And then, when a value multiplied by the coefficient with respect to the actual ejection frequency counted by the dot number counting mechanism exceeds the setting value, the wiping interval adjusting mechanism commands the wiping mechanism to perform the wiping of the ejection port face. Accordingly, at every printing mode different in the interval of the ink ejection from the adjacent ejection port, the timing of wiping can be determined. This can perform wiping at a suitable timing according to the amount of generation of the ink mist different in the printing mode. Consequently, a condition in which a part or all of the ejection port is covered by the adhered ink because a frequency at which wiping is performed is excessively less, and the impacting accuracy decreases, or the ink cannot be ejected can be suppressed to occur. Furthermore, a condition in which printing is interrupted by a wiping because the frequency at which wiping is performed is excessively larger than necessary frequency and then the printing time is made to be long, consequently, the throughput in the printing decreases can be suppressed to occur.

Other Embodiment

In the above-mentioned embodiment, the coefficient is determined according to the time interval at which the ink is ejected between the adjacent ejection ports, and then the weighting count value D is obtained by multiplying the coefficient to the value of the dot number counted in the printing. Additionally, when the weighting count value D exceeds a setting value set in advance, wiping is performed. However, the present invention is not limited to the above-mentioned embodiment, the setting value Dw can be determined according to the interval of the drive timing between the heaters arranged at the location corresponding to the adjacent ejection port. Furthermore, by comparing the count value counted by the actual printing dot number with the setting value Dw set at every printing mode, wiping can be performed when the actual count value exceeds the setting value Dw. That is, wiping the ejection port face by the wiping mechanism is performed when the actual ejection frequency counted by the dot number counting mechanism exceeds the pre-set setting value Dw. Specifically, regarding the setting value, the longer the interval of the drive timing between the heaters arranged at the location corresponding to the adjacent ejection port becomes, the smaller it becomes. Furthermore, conversely, the shorter the interval of the drive timing between the heaters arranged at the location corresponding to the adjacent ejection port becomes, the larger it becomes. Accordingly, with respect to the printing mode long in the interval of the drive timing between the heaters arranged at the location corresponding to the adjacent ejection port, the interval at which wiping is performed is shortened. Furthermore, with respect to the printing mode which has short interval of the drive timing between the heaters arranged at the location corresponding to the adjacent ejection port, the interval at which wiping is performed is made to be long. When this method is employed to the printing apparatus 1 in the present embodiment, in the printing mode III generates relatively large amount of the ink mist, the setting value Dw in the count number of the printing dot is set small. Conversely, in the printing mode I which generates relatively small amount of the ink mist, the setting value Dw in the count number of printing dots is set large.

Furthermore, according to ink viscosity or ejection frequency, in a case in which a printing scan frequency in a multi-pass printing is large, and printing duty at 1 time printing scan is less or the like, the interval of the drive timing between the heaters arranged at the location corresponding to the adjacent ejection port sometimes becomes very long. When the interval of the drive timing is very long accordingly, a vibration of phase boundary of ink caused by the ink ejection from the adjacent ejection port is attenuated, and the ink can be ejected at a stable condition, therefore, the amount of generation in connection with the ink ejection is made to decrease. Therefore, when the drive timing between the heaters arranged at the location corresponding to the adjacent ejection port is longer than a predetermined interval, the setting value Dw can be set large.

Furthermore, the coefficient multiplied to the setting value Dw can be set at every printing mode. At this time, in the printing mode which has long interval of the drive timing between the heaters arranged at the location corresponding to the adjacent ejection port, since the interval of wiping is required to be set short, the coefficient multiplied to the setting value Dw is set small. Conversely, in the printing mode which has short interval of the drive timing between the heaters arranged at the location corresponding to the adjacent ejection port, the coefficient multiplied to the setting value Dw is set large.

Furthermore, in the present embodiment, the printing modes different in the interval of the drive timing between the heaters arranged at the location corresponding to the adjacent ejection port are set to 3, and then according to this, 3 wiping intervals are set. However, the present invention is not limited to this. In the printing apparatus, with respect to the interval variable of the drive timing between the heaters arranged at the location corresponding to the adjacent ejection port, the wiping timing can be continuously varied. For continuously varying the wiping timing, the coefficient can be continuously varied, or the setting value Dw can be continuously varied.

Furthermore, regarding the above-mentioned recovery operation, other recovery operations such as preliminary ejecting operation or the like in addition to suction recovery and wiping can be performed before and after these processes. The preliminary ejecting operation is a process of ejecting the predetermined amount of ink after capping the ejection port face in the printing head in addition to a process of ejecting the ink for the printing.

Additionally, the above-mentioned printing apparatus is a so-called serial scan type printing apparatus which prints an image in connection with a transfer in the main scanning direction of the printing head, and a conveyance in the sub scanning direction of the printing medium. The present invention, however, can also be employed to a full line type printing apparatus using a longitudinal printing head extending over all regions of the printing medium in the width direction.

Furthermore, the liquid ejecting apparatus can be a liquid ejecting apparatus ejecting liquid for other purposes except for the printing apparatus without being limited to a usage for the printing apparatus only.

Moreover, the [ink] and the [liquid] should be widely interpreted, and defined to be a liquid used for forming images, designs, patterns or the like, processing the printing medium, or treating the ink or the printing medium in such a way that it is given on the printing medium. Here, the treatment of the ink or the printing medium is defined to be a process of improving fixing ability damaged by a solidification or insoluble phenomenon of color material inside the ink given to the printing medium, or improving printing quality or coloring ability, moreover, improving image durability or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-147475, filed Jun. 1, 2007, which is hereby incorporated by reference herein in its entirety.

What is claimed is:

1. A printing apparatus performing a printing of an image by ejecting ink from a printing head in which a plurality of ejection ports is arranged, the printing apparatus comprising:

a wiping mechanism capable of wiping an ejection port face in which the plurality of ejection ports is arranged;

an ejection energy generating element drive mechanism which drives a plurality of blocks of ejection ports at a block unit in order;

a printing mode setting mechanism which sets a printing mode used in printing from a plurality of printing modes different in drive interval in which the ejection energy generating element corresponding to an adjacent ejection port is driven at the block unit; and a wiping interval adjusting mechanism configured to control a drive of the ejection energy generating element at an order of the drive corresponding to the printing mode set, wherein the wiping interval adjusting mechanism makes an interval from a last wiping to a next wiping different according to the printing mode.

2. An ink jet printing apparatus performing a printing based on printing data by ejecting ink from a printing head in which a plurality of ejecting ports is arranged, the ink jet printing apparatus comprising:

a selecting unit which selects a printing mode from a first printing mode and a second printing mode and performs printing based on the selected printing mode, wherein the first printing mode is a printing mode that the ink jet printing apparatus ejects ink at an interval of predetermined time between adjacent ejection ports, and the second printing mode is a printing mode that the ink jet printing apparatus ejects ink at an interval of time longer than the predetermined time in the first printing mode between adjacent ejection ports;

a wiping mechanism capable of wiping an ejection port face in which a plurality of ejection ports is arranged;

a count unit counting a frequency of a number of ejecting the ink based on the printing data;

a calculation unit which performs a weighting processes which a coefficient different from each printing mode and set to respective printing modes is multiplied to the number of counts which is counted by the count unit; and a wiping controlling unit which activates the wiping mechanism when the number of counts which is weighted by the calculation unit exceeds a predetermined value.

3. An ink jet printing apparatus performing a printing by ejecting ink from a printing head including an ejection port face in which a plurality of ejecting ports is arranged, the ink jet printing apparatus comprising:

a selecting unit which selects a printing mode from a first printing mode and a second printing mode and performs printing based on the selected printing mode, wherein the first printing mode is a printing mode that the ink jet printing apparatus ejects ink at an interval of first predetermined time between adjacent ejecting ports, and the second printing mode is a printing mode that the ink jet printing apparatus ejects ink at an interval of second predetermined time, which is longer than the first predetermined time, between adjacent ejecting ports;

a count unit counting a number of ejecting the ink from the plurality of ejection ports;

a wiping mechanism capable of wiping the ejection port face;

a wiping controlling unit which makes the wiping mechanism perform the wiping when a value where the number of ejecting the ink counted by the count unit is multiplied by a coefficient determined according to the printing mode is equal to or exceeds a predetermined value.

4. An apparatus according to claim 3, wherein the coefficient in case of the second printing mode is larger than that of the first printing mode.

5. An ink jet printing apparatus performing a printing by ejecting ink from a printing head including an ejection port face in which a plurality of ejecting ports is arranged, the ink jet printing apparatus comprising:

a selecting unit which selects a printing mode from a first printing mode and a second printing mode and performs printing based on the selected printing mode, wherein the first printing mode is a printing mode that the ink jet printing apparatus ejects ink at an interval of first predetermined time between adjacent ejecting ports, and the second printing mode is a printing mode that the ink jet printing apparatus ejects ink at an interval of second predetermined time, which is longer than the first predetermined time, between adjacent ejecting ports;

a count unit counting a number of ejecting the ink from the plurality of ejection ports;

a wiping mechanism capable of wiping the ejection port face;

a wiping controlling unit which makes the wiping mechanism perform the wiping when the number of ejecting the ink counted by the count unit is equal to or exceeds a setting value determined according to the printing mode.

6. An apparatus according to claim 5, wherein the setting value in case of the second printing mode is smaller than that of the first printing mode.

* * * * *